United States Patent [19]

Lasch

[11] 4,075,965

[45] Feb. 28, 1978

[54] SYSTEM FOR RENDERING A MOORED HULL SELF-BAILING

[76] Inventor: Frank J. Lasch, 60 Manning Blvd., Albany, N.Y. 12207

[21] Appl. No.: 697,744

[22] Filed: Jun. 18, 1976

[51] Int. Cl.[2] ..... B63C 1/02

[52] U.S. Cl. ..... 114/49; 114/183 R

[58] Field of Search ..... 9/1.2; 114/44, 45, 49, 114/53, 54, 123, 183 R, 183 A, 184, 185, 229, 263

[56] References Cited

U.S. PATENT DOCUMENTS

| | | | |
|---|---|---|---|
| 2,389,338 | 11/1945 | Zorc, Jr. | 9/1.2 |
| 2,984,201 | 5/1961 | Crabb | 114/183 R |
| 3,481,300 | 12/1969 | Utvik | 114/185 |
| 3,570,256 | 3/1971 | Thompson | 114/.5 BD |
| 3,742,534 | 7/1973 | Guest | 9/1.2 |
| 3,895,592 | 7/1975 | King | 114/45 |

*Primary Examiner*—Trygve M. Blix

*Assistant Examiner*—Stuart M. Goldstein

*Attorney, Agent, or Firm*—Clarence A. O'Brien; Harvey B. Jacobson

[57] ABSTRACT

A pair of generally cylindrical inflatable bodies are provided for transverse disposition beneath the bow and stern bottom portions of a boat equipped with a transom drain opening and internal flotation. Straps are attached to the ends of the inflatable bodies and extend upwardly along the corresponding sides of the boat and across the upper surfaces thereof and are joined together in order to strap the inflatable bodies in position beneath the bow and stern bottom portions of the boat. The bodies may be inflated after being secured in position in order to buoy the boat to an elevated position above its normal floating position and the transom drain opening may be thereafter opened to allow any rain water or wave spray entering the boat to automatically drain therefrom through the transom drain opening.

1 Claim, 5 Drawing Figures

SYSTEM FOR RENDERING A MOORED HULL SELF-BAILING

BACKGROUND OF THE INVENTION

Many boat hulls are constructed with double bottoms between which ample flotation is disposed whereby the drain opening in the transom of the boat may be left open and any rain or spray water entering the boat will automatically be drained therefrom to prevent the boat from being swamped. However, other boats provided with transom drain openings and interior flotation are designed in a manner whereby the flotation is sufficiently buoyant only to keep the boat from sinking, but is not sufficiently buoyant to prevent the interior deck surfaces of the boat from becoming awash if the transom drain opening is left open. Still further, if the first mentioned type of self-bailing boat is equipped with a heavy stern mounted outboard motor, although the interior flotation may be sufficient to maintain the interior of the boat substantially free of the accumulation of water when the transom drain opening is left open, the added weight of the out-board motor on the transom is sufficient to cause at least the aft interior deck portions of the boat to become awash.

Accordingly, a need exists for structure whereby self-bailing boats and boats provided with sufficient interior flotation to prevent sinking may be transformed into substantially fully self-bailing boats, even when a heavy outboard motor is supported from the transom thereof.

Various forms of flotation devices have been heretofore designed for different purposes, but none have been constructed in a manner whereby they may be readily used in conjunction with smaller boat hulls in order to transform such hulls into full self-bailing hulls.

Examples of previously known flotation devices including some of the general structural features of the instant invention are disclosed in U.S. Pat. Nos. 26,856, 1,796,595, 2,892,434, 3,198,157, 3,797,435 and 3,844,241.

BRIEF DESCRIPTION OF THE INVENTION

The system of the instant invention utilizes a pair of elongated generally cylindrical inflated bodies for transverse disposition beneath the bow and stern bottom surfaces of a boat equipped with a transom drain opening but which is not of the full self-bailing type. The cylindrical bodies are equipped with straps on their opposite end portions whereby the straps may be directed upwardly along the sides of the associated boat and secured together over the upper surfaces of the boat in order to secure the inflatable bodies in position beneath of the bow and stern bottom surfaces of the hull. After the inflatable bodies have been secured in position, they may be inflated in order that the associated boat hull may be buoyed up to a position above its normal floating level and the plug closing the transom drain opening may be removed. Thereafter, any rain or spray water accumulating within the interior of the boat hull will be at an elevation above the ambient water level and may drain from the boat through the transom drain opening. By this construction a boat may be left unattended for extended periods of time and without a protective cover thereover to shed rain and spray water without fear of the boat hull being swamped.

The main object of this invention is to provide a flotation system for small boat hulls which may be readily secured in operative position on an associated boat hull and utilized to buoy the boat hull to an elevated position above its normal floating level.

Another object of this invention is to provide a flotation system constructed in a manner whereby it may be readily stored during periods of non-use in a compact state.

Still another object of this invention is to provide a flotation system in accordance with the preceding objects and constructed in a manner whereby a single person may readily secure the flotation system in operative position relative to an associated boat hull.

Another very important object of this invention is to provide a flotation system which may also be readily operatively associated with a partially swamped boat hull and utilized in order to drain the water from the partially swamped boat hull.

Another important object of this invention is to provide a flotation system including bow and stern components which may be actuated to provide varied amounts of additional flotation to a moored boat hull at the bow and stern portions thereof so as to compensate for varying equipment loading of the boat hull and outboard motors of different weight.

Yet another object of this invention is to provide a boat flotation system including bow and stern components which may be used separately or together to buoy up an entire boat hull, only the bow end of the boat hull or only the sterm end of a boat hull.

A final object of this invention to be specifically enumerated herein is to provide a boat flotation system in accordance with the preceding objects and which will conform to conventional forms of manufacture, be of simple construction and easy to use, so as to provide a device that will be economically feasible, long-lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
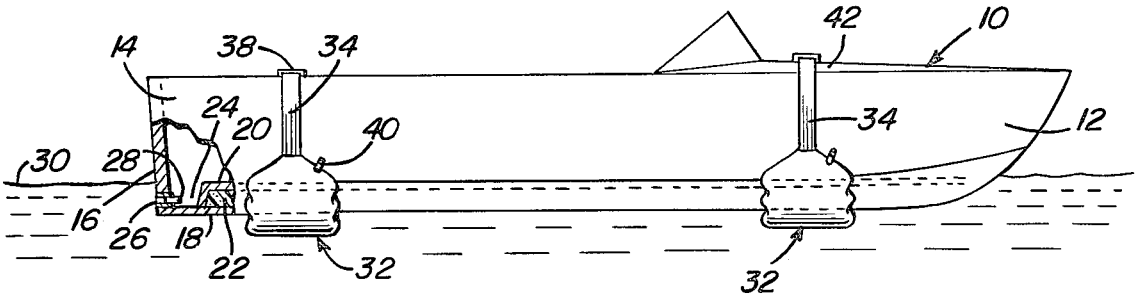
FIG. 1 is a side elevational view of a boat hull with the system of the instant invention operatively supported therefrom and the inflatable members thereof in deflated condition, an aft portion of the hull being broken away and shown in vertical section to illustrate the bailing well and closed drain opening.

Referring now more specifically to the drawings, the numeral 10 generally designates a conventional form of boat of the runabout-type. The boat 10 includes bow and stern ends 12 and 14 and the stern end 14 includes a transverse transom 16. The boat 10 further includes an outer bottom 18 and an inner bottom 20 with the spacing between the inner and outer bottoms 18 and 20 substantially filled with flotation material 22 whereby the boat 10 may be floated at least partially out of the water even when the bottom or sides of the boat are holed and the ambient water has free access to the interior of the boat 10 above the inner bottom 20.

The stern end 14 includes a shallow well 24 which opens up into the interior of the boat 10 above the inner bottom 20 and the transom 16 has a pair of drain openings 26 formed therein with which closure plugs 28 are operatively associated.

The foregoing comprises a description of a conventional form of boat hull and it is to be understood that the flotation 22 offers sufficient buoyancy to the boat 10 in order that the aft portion of the inner bottom 20 will be maintained above the level 30 of the ambient water even when the plug 28 is removed.

However, if the boat 10 has an outboard motor (not shown) mounted on the transom 16 thereof, sufficient loading of the aft end portion 14 of the boat 10 is represented by the outboard motor in order to cause the stern end 14 to settle, at least slightly, resulting in the level 30 of the ambient water being disposed above at least the aft end portion of the inner bottom 20, perhaps to a point forward of the well 24 approaching the longitudinal center of the water line of the boat 10. When this condition occurs deck carpeting and equipment resting on the rear portion of the inner bottom 20 is continuously subject to inundation by water.

Also, if the boat hull 10 did not include the sealed inner bottom 20, removal of the plug 28 would result in the boat 10 being substantially fully swamped.

The system of the instant invention includes a pair of elongated inflatable bodies referred to in general by the reference numerals 32. Each body 32 is generally cylindrical in configuration and constructed of water resistant and air impervious flexible material. The opposite ends of each body 32 include attaching straps 34 and 36 whose free ends may be removably joined together by means of a buckle 38 carried by the strap 36. In addition, each body 32 includes an air inflation and deflation valve 40 to which an extension hose (not shown) may be operatively connected.

When it is desired to float the boat 10 at a level above the normal floating level thereof illustrated in FIG. 1 in order that the plug 28 may be removed and substantially all water entering the boat 10 either as rain or by sea spray may be drained therefrom, a first of the inflatable bodies is passed rearwardly down the boat 10 beneath the bow end portion thereof to a position such as that illustrated in FIG. 1 and the straps 34 and 36 of the first inflatable body 32 are secured together by means the buckle 38 over the forward deck 42 of the boat 10. Then, the second inflatable body 32 is moved forwardly beneath the stern end portion 14 of the boat 10 to the position thereof illustrated in FIG. 1 and of the straps 34 and 36 of the second inflatable body are secured together over the upper sides of the boat 10. Thereafter, the inflatable bodies 32 may be inflated by means of a hand pump, an electrical actuated air pump driven from the electrical system of the boat 10 or a dockside source of air under pressure.

The amount of air pumped into the inflatable members 32 will be sufficient to maintain the boat 10 in an elevated and slightly bow upward attitude and with a substantial portion of the weight of the boat 10 buoyed up by the inflated members 32 in order that the plug 28 may be removed without ambient water entering the boat 10 to a level above the top of the well 24. Of course, if the boat 10 does not include the sealed inner bottom 20, additional air must be pumped into the inflatable members 32 in order to maintain the lowermost portion of the drain opening 26 at least slightly above the level of the ambient water 30.

It is envisioned that the buoyancy system of the instant invention may be utilized in conjunction with boats which are left uncovered and unattended for long periods of time and which, therefore, normally accumulate considerable quantities of rain and sea spray water therein. Further, the buoyancy system may be utilized in conjunction with a normally self-bailing boat which is moored with a heavy outboard motor mounted on the transom thereof. Still further, the buoyancy system comprising the inflatable members 32 may be readily stored in a compact condition and stowed on the boat for use in an emergency in the event damage to the boat is incurred resulting in ambient water floading the interior of the boat. In this instance, the inflatable members 32 will have to be inflated by means of an onboard air pumping system and it is therefore advisable to maintain a hand air pump available on board for the purpose of inflating the members 32 in an emergency.

Figure 2:
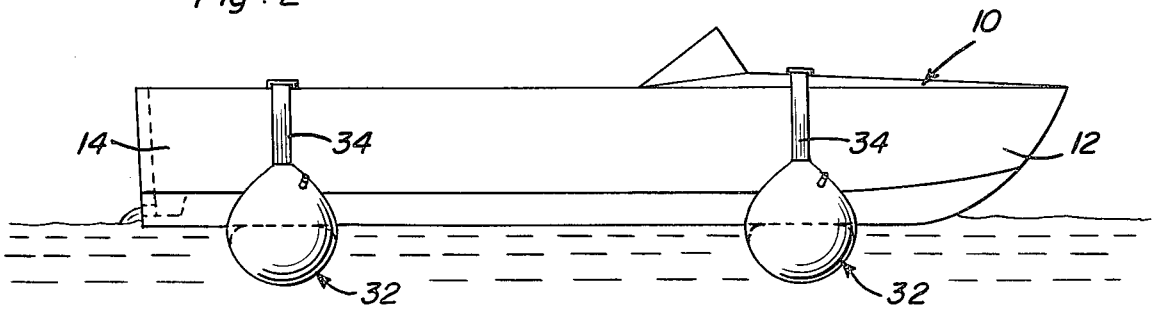
FIG. 2 is an elevational view similar to FIG. 1 but with the inflatable members of the system in inflated condition and the boat hull elevated above its normal floating level so as to enable interior water to drain therefrom through the transom drain opening.
Figure 3:
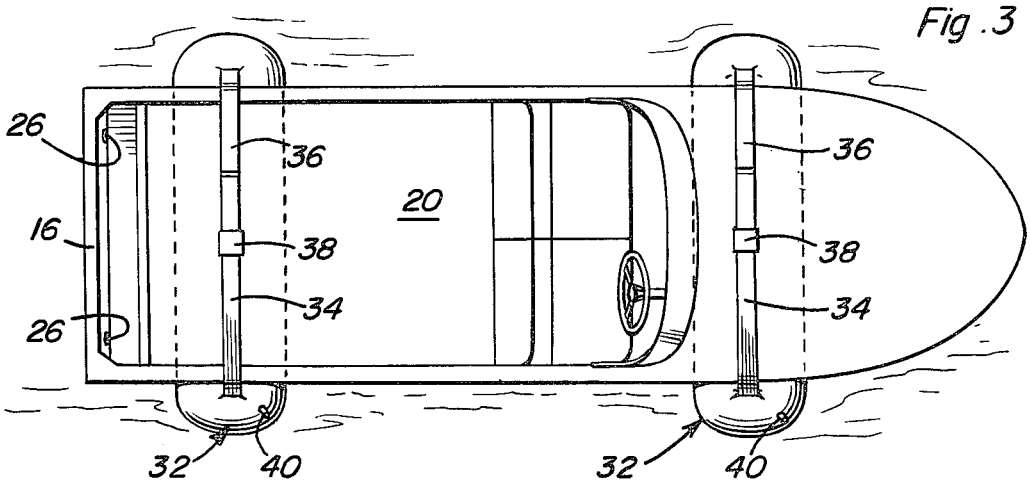
FIG. 3 is a top plan view of the assemblage illustrated in FIG. 2.
Figure 4:
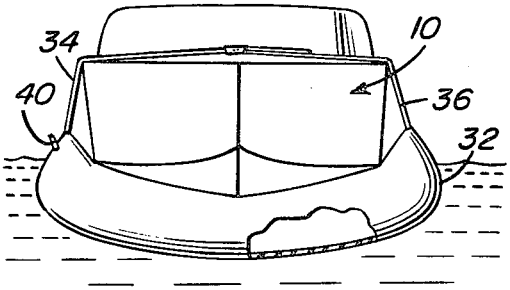
FIG. 4 is a front elevational view of the assemblage illustrated in FIGS. 1–3 and with a portion of the forward inflatable member broken away and illustrated in vertical section.
Figure 5:
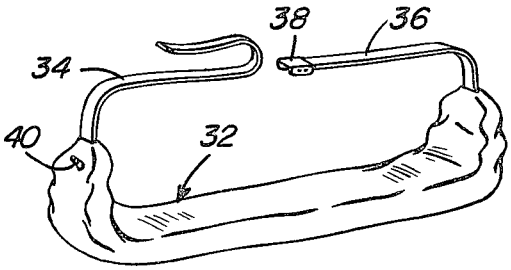
FIG. 5 is a perspective view of one of the inflatable members.

The straps 34 and 36 are preferably constructed of elastic material whereby a tight clamping action to maintain the inflatable members 32 in position will be provided. This clamping action will, of course, prevent the inflatable members from being dislodged from their operative positions illustrated in FIGS. 2 and 3. Further, the inflatable members may be constructed whereby they comprise separate opposite end inflatable compartments. In this manner, greater reliability of the inflatable members would be assured.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. A system for preventing the accumulation of rain and spray water in a boat hull, at least one drain hole at the bottom of the hull which is normally plugged and rides beneath the water line, and a buoyant arrangement which may be transversely secured beneath the hull of the boat to buoy the latter to an elevation with the drain hole above the water line and the hull in a slight bow up attitude whereby the hole may be unplugged and any water tending to collect within the boat may be drained therefrom through the drain hole, said buoyant arrangement comprising a pair of elongated, flexible and independently inflatable flotation members removably secured transversely beneath the bow and stern of the boat so as to underride the hull, said inflatable members each having a longitudinal extent greater than the width of the hull, an elongated, adjustable length tension member attached to and connected between the opposite ends of each inflatable member and passed over the upper side of said hull, each tension member comprising a pair of elastic straps secured at one pair of ends to the opposite ends of the corresponding inflatable member and including coacting releaseably securable and adjustable fastening means at their other pair of corresponding ends.

* * * * *